United States Patent [19]

Kinnan

[11] Patent Number: 4,697,649

[45] Date of Patent: Oct. 6, 1987

[54] PORTABLE APPARATUS FOR AND METHOD OF POLE REINFORCEMENT

[75] Inventor: Frank R. Kinnan, Camas Valley, Oreg.

[73] Assignee: Utilitech, Incorporated, Walnut Creek, Calif.

[21] Appl. No.: 674,538

[22] PCT Filed: Aug. 15, 1984

[86] PCT No.: PCT/US84/01295

§ 371 Date: Oct. 15, 1984

§ 102(e) Date: Oct. 15, 1984

[87] PCT Pub. No.: WO86/01251

PCT Pub. Date: Feb. 27, 1986

[51] Int. Cl.[4] ..... E02D 5/56; E21B 3/02; E21B 7/20; E04H 12/22

[52] U.S. Cl. ..... 175/19; 52/728; 175/162; 175/171; 175/195; 175/323; 405/232

[58] Field of Search ..... 175/171, 170, 195, 22, 175/20, 19, 323, 203; 37/2 R; 405/216, 231, 232; 52/514, 728

[56] References Cited

U.S. PATENT DOCUMENTS

| | | | |
|---|---|---|---|
| 2,136,151 | 11/1938 | Parrish | 175/171 X |
| 2,385,869 | 10/1945 | Lane | 52/728 X |
| 2,856,158 | 10/1958 | Richardson et al. | 175/170 X |
| 2,897,553 | 8/1959 | Gorrow | 52/728 X |
| 3,053,330 | 9/1962 | Arthur | 175/170 X |
| 3,453,832 | 7/1969 | Rehmar | 175/171 X |
| 3,779,322 | 12/1973 | Stevens | 175/171 X |
| 4,068,396 | 1/1978 | Langguth | 37/2 R |

*Primary Examiner*—Stephen J. Novosad
*Attorney, Agent, or Firm*—Kolisch, Hartwell & Dickinson

[57] ABSTRACT

The technical field of the invention generally concerns groundline reinforcement of elongate objects such as a pole (20) and, in particular, a portable appartus (50) for installing an improved cylindrical split casing (30) around both the subterranean and above-ground portions of such an elongate object without cutting, moving, or otherwise disturbing it. The split casing (30) is assembled from two partial cylinders (32) having helical threads (34) formed at one end for engaging the ground (24) about the pole (20). Assembly of these two partial cylinders (32) about the pole (20) establishes a hollow annulus (44) between the pole (20) and the split casing (30). The apparatus (50) for installing the split casing (30) includes a split shell casing rotary drive (52) which is rigidly secured circumferentially about the assembled split casing (30). Also included in the apparatus (50) is a rotary driver (90) which mates with, engages, and is supported upon the split shell casing rotary drive (52). The rotary driver (90), which is restrained from rotating about the pole (20), applies a torque to the split shell casing rotary drive (52) which causes the split casing (30) to rotate about its longitudinal axis (37) thereby causing it to be drawn downward into the ground (24) about the pole (20). After the split casing (30) has been driven into the ground about the subterranean portion (22) of the pole (20), the hollow annulus (44) is filled with filler material (230) thus completing the pole reinforcement process.

19 Claims, 15 Drawing Figures

PORTABLE APPARATUS FOR AND METHOD OF POLE REINFORCEMENT

TECHNICAL FIELD

This invention relates generally to the technical field of installing in-ground support footings around upstanding, elongate objects such as structural poles, posts, pilings and the like to increase their structural integrity and more particularly to a novel portable apparatus and assembly for, and a novel method of installing a cylindrical metal casing around both the subterranean and above-ground portions of such an elongate object without cutting, moving, or otherwise disturbing that object.

BACKGROUND ART

Upstanding, elongate objects such as wooden structural poles, posts, pilings and the like eventually deteriorate structurally after they have been installed in the ground for an interval of time. One particular type of such deterioration, frequently referred to as "groundline rot," is damage to the wooden, elongate object caused by moisture, insects, fungi, or other wood destroying organisms about the point along the pole's length at which it enters the ground, i.e. about the pole's "groundline." The section of the pole thus damaged may extend between one-half to one meter along the pole's length into the ground beneath the pole's groundline and may extend a similar distance along its length upward above its groundline. This groundline rot not only reduces the pole's compressive, load carrying capacity, but also reduces its bending and shear strengths. In addition to the normal deterioration of wooden poles about their groundline as described above which is caused by a pole's exposure to the elements, analogous structural groundline damage may also occur if a pole is struck by a motor vehicle or, in rural areas, if struck by livestock. To prevent catastrophic failure of a weakened pole particularly under stress such as during a storm, maintenance must be performed periodically to ensure the continuing structural soundness of poles.

A most common technique for maintaining the structural integrity of poles is to periodically inspect them for structural damage and then to simply replace excessively weakened ones. If a pole to be replaced supports electrical wires, power lines, for the transmission of electricity, replacing it first requires that electrical power be removed from the power lines so they can be physically disconnected from the top of the pole. Such removal of electrical power from a power line, of course, discontinues electrical service to a utility's customers serviced by that line. Once the power lines have been disconnected from the top of the pole, the pole is then held by some type of grapple or other device while it is cut off near its groundline. After the pole has been severed, its upper portion is removed, the underlying stump dug up, and a new pole reinserted into the same hole from which the stump was removed. The replacement pole must be installed in the same physical location as that occupied by a weakened pole so the power lines may be supported in the same general location when reinstalled at the top of the new pole. Because discontinuing electrical service to a utility's customers results in a revenue loss to the utility and because of the cost for labor and materials involved in replacing a pole, it is readily understood that replacing a pole is expensive.

Because weakened poles frequently remain structurally sound other than for groundline rot or similar groundline damage, it has been recognized for some time that reinforcing poles about their groundline to restore lost strength could obviate the need for their replacement. One rather unsophisticated pole reinforcement technique consists simply in first placing a shorter section of pole or similar structural member into the ground immediately adjacent to the weakened pole. Then the sound upper portion of the weakened pole above its groundline is secured to this immediately adjacent reinforcement. An analogous technique is that taught in U.S. Pat. No. 405,658 issued to M. E. Campany entitled "Pole or Post Protector." The technique taught in that patent consists in driving elongated, semicircular sheet metal braces shaped to fit the outer surface of a pole into the ground immediately adjacent to and on opposite sides of a structurally weakened pole. After these sheet metal braces have been embedded into the ground about the pole, metal straps are then secured about them above the ground to secure the weakened pole between them. A slightly simpler technique employs only a single metal sheet metal brace driven into the ground immediately adjacent to a pole to which the pole is then secured with metal straps. The principal problem with these various pole reinforcement techniques is that they restore a weakened pole's strength principally along a plane passing through the longitudinal axes of the pole and of its reinforcement while providing significantly less reinforcement in directions perpendicular to that plane.

Rather than attempting to reinforce a weakened pole, one pole repair technique, identified commercially as ModPole TM, replaces the in-ground and weakened above-ground portions of a pole with a precast concrete pole base replacement. To install this precast concrete pole base replacement, again the pole must first be held by some type of grapple or other device while it is cut off above the groundline damage. After the pole has been thus severed, the grapple is then used to hold the pole to one side while the in-ground portion of the pole is pulled out of the ground together with the weakened portion. The hole remaining after the in-ground portion has been thus extracted is then cleaned out with an auger and the precast concrete pole base replacement inserted therein. With the pole base replacement thus installed in the ground, the base of the pole's upper portion, which has been held to one side by the grapple after being severed from the lower portion, is then inserted into a hollow, cylindrically shaped socket provided on the upper end of the precast concrete pole base replacement. The socket provided on the upper end of the pole base replacement is fabricated with a significantly larger diameter than that of the pole which it receives so that a hollow annulus is established between the outer surface of the pole's base and the inner surface of the socket. Thus, after the pole's base has been inserted into the socket it is secured there by filling this hollow annulus with a grouting material.

One significant disadvantage of repairing a pole with the ModPole technique, is that the pole must be supported and moved while the precast concrete pole base replacement is installed. Consequently, this technique for repairing a weakened pole may require removing the power lines from and reinstalling them at the top of the pole analogous to performing a complete pole replacement. Even if physical disconnection of the power lines from the top of a pole is unnecessary, the movement of the pole and the possibility of an accident are sufficiently great that discontinuing power transmission is necessary while a pole is repaired. Thus, the lost revenue from discontinued electrical service plus the possible expense of disconnecting and reconnecting the power lines at the top of the pole make ModPole base replacement comparatively expensive. A further difficulty associated with performing a pole repair using the ModPole technique is transporting the relatively heavy precast concrete pole base replacement from the site at which it is fabricated to the pole repair site. Lastly, the relative mass of the ModPole's heavy precast concrete pole base replacement in comparison with a conventional wooden pole significantly increases a utility company's exposure to liability for personal injury if a repaired pole is struck by a motor vehicle.

Yet another pole reinforcement technique is described in a presently pending Patent Cooperation Treaty International Application No. PCT/US84/00043 entitled "Techniques for Establishing Inground Support Footings and for Strengthening and Stabilizing the Soil at Inground Locations" filed by Frank R. Kinnan on Jan. 16, 1984 which claimed the priority date of U.S. patent application Ser. No. 458,817 filed by Frank R. Kinnan on Jan. 18, 1983 which is presently assigned to the Electrical Power Research Institute of Palo Alto, Calif. The technique described in that patent application, which is sometimes referred to as "stubbing," reinforces the weakened section of a pole by surrounding it with a unitary, outer, hollow metal casing. This casing is fabricated with a diameter slightly larger than that of the weakened pole so a hollow annulus is established between the casing and the pole. As with the ModPole base replacement, this hollow annulus is filled with a grouting material and sand to complete the pole reinforcement. As described in that patent application, installing this reinforcing structure about a weakened pole again first requires holding it with some type of grapple or other device while it is cut off near its groundline similar to complete pole replacement or ModPole base replacement. After the pole has been thus severed, similar to ModPole base replacement the grapple is then used to hold the pole to one side while the casing is driven partially into the ground around the pole's remaining stump by a rotary casing driving apparatus secured about the casing's upper edge. With the casing in place, the upper portion of the pole, which has been held to one side by the grapple while the casing was driven into the ground, is then inserted into the open end of the casing projecting upward out of the ground and mated with the stump from which it was severed. Once the upper portion of the pole has been mated with the stump, the hollow annulus between the outer casing and the pole is filled with the grouting material and sand.

While the structural characteristics of this stubbing technique are such that the strength of a reinforced pole is as great as that of a new one, it shares one of the ModPole's disadvantages in that the pole must be supported, cut off, and moved while the reinforcing casing is installed. Thus, simply the lost revenue from discontinued electrical service plus the possible expense of disconnecting and reconnecting the power lines at the top of the pole make the total cost of pole stubbing substantially similar to those for outright pole replacement. Further, because the upper extent of a pole also deteriorates although at a slower rate than at the groundline, the usable service life of a pole reinforced by stubbing is less than that of a new pole. Hence pole stubbing does not offer a significantly attractive cost savings to utility companies in comparison with total pole replacement.

A simpler and markedly more cost effective pole reinforcement technique than stubbing is described in a presently pending Patent Cooperation Treaty International Application No. PCT/US83/01878 entitled "Method and Apparatus for Installing an In-Ground Support Footing Around an Upstanding Elongate Object" filed by Frank R. Kinnan on Dec. 1, 1983 which is assigned to the assignee of the present application. The technique described in that patent application is similar to stubbing except that the metal casing driven into the ground around a weakened pole is assembled from two identical, complementary half-cylinders and is therefore frequently referred to as a "split casing." As taught in that patent application, such a split casing is assembled about a weakened utility pole and driven into the ground about the pole without need for cutting it off, disturbing it, disconnecting the power lines at the top of the pole, or even discontinuing power transmission over the line.

The particular apparatus described in that patent application for driving the split casing into the ground about a weakened pole is a vehicle mounted casing driver unit having a pair of movable jaws hinged together at one end and openable at the other. Thus after the two halves of a split casing have been assembled about a weakened pole, the jaws on this casing driver unit are opened, positioned about the assembled casing, and then closed to surround the casing with their inner surface securely engaging it. This innermost portion of the casing driver's jaws which engage the casing are adapted to rotate about an axis substantially collinear with that of the assembled casing and are further adapted to engage the casing's uppermost edge. Thus, once the casing driver's jaws have closed about the casing and their innermost portion engage it, power may be applied to the casing driver unit to rotate the casing about its longitudinal axis and to apply a force to the casing urging it downward into the ground about the weakened pole. Once this split casing is installed about the pole, the hollow annulus between the casing and the pole is filled with the grouting material and sand thus completing the pole's reinforcement.

All of the prior pole repair techniques described above require using heavy equipment of the type most frequently used in the construction industry. Thus, this equipment such as the casing driver unit described above is well suited to installing split casings about weakened poles only in locations which may be easily reached by the vehicle on which it is mounted. However, in certain urban areas, utility poles are installed along the property line which separates two adjoining lots of land facing onto parallel streets ("lot line poles"). While, in principle, lot line poles could be repaired using vehicle mounted equipment, some persons occupying the land over which such vehicles must pass to reach a pole are certain to resist that use of their land. Further, if structures such as fences or buildings block ready access to a lot line pole, the cost of clearing an access way prior to performing a pole repair and restoring the land to its prior state after a pole has been restored would, in many instances, be so great as to make pole repair economically impractical. Analogously, certain utility poles in rural areas are installed in terrain in which they are virtually impossible to reach with a vehicle. Thus, in general, all the pole repair techniques described above are unsuitable for repairing lot line poles and particular rural poles because of the heavy equipment which they require for performing a pole repair.

DISCLOSURE OF THE INVENTION

An object of the present invention is to provide an improved pole repair technique suitable for repairing lot line poles.

Another object of the present invention is to provide an assembly for pole repair which can be made sufficiently light so that it can be manually carried as separate pieces to a pole repair site.

Another object of the present invention is to provide an assembly for pole repair which may be quickly and easily assembled at a pole repair site.

Another object of the present invention is to provide an apparatus for pole repair which may be made sufficiently light to allow manually carrying it to a pole repair site.

Another object of the present invention is to provide a split casing for pole repair which may be installed about the subterranean portions of a pole with the application of only a small downward force urging it into the ground.

Briefly, the present invention is an assembly for and method of installing an in-ground support footing around the subterranean portion of an upstanding, elongate object, such as a structural pole, post or the like and around the immediately adjacent above-ground portions thereof, for increasing the object's structural integrity. The assembly includes an improved split casing which is installed as an in-ground support footing around the elongate object and a portable apparatus for installing that improved split casing. The improved split casing includes two partial cylinders which both have helical threads formed at one of their terminal ends. Assembly of these two partial cylinders about a pole to form the improved split casing establishes an annulus between the pole and the casing. The improved split casing also includes a cutting means located about the helically threaded portion of the partial cylinders which engages the ground surrounding the subterranean portion of the elongate object. This cutting means is adapted for drawing the improved split casing downward into the ground as the casing is rotated about its longitudinal axis. One particular embodiment of the cutting means includes a flat tooth projecting downward beneath the helically threaded portion of the partial cylinders. Another embodiment of the cutting means includes an arcuate rib which projects outward from the outermost crests of the helically threaded portion of the partial cylinders.

The portable apparatus for installing the improved split casing includes a split shell casing rotary drive which is rigidly secured circumferentially about the assembled casing. The split shell casing rotary drive is adapted to couple a torque to the improved split casing for urging the casing to rotate about its longitudinal axis. In the particular embodiment disclosed herein the outermost surface of the assembled split shell casing rotary drive forms a continuous sprocket which encircles the casing to receive a driving chain. Also included in the portable apparatus for installing the improved split casing is a rotary driver which mates with, engages and is supported upon the split shell casing rotary drive. In the particular embodiment disclosed herein the rotary driver includes a hydraulic motor which is coupled to the split shell casing rotary drive by a driving chain which engages the continuous sprocket encircling the casing. Thus by energizing the hydraulic motor a torque is applied to the split shell casing rotary drive which urges it and the split casing to which it is secured to rotate about the casing's longitudinal axis. This rotation of the casing about its longitudinal axis causes it to be drawn downward into the ground about the subterranean portion of the elongate object to whatever depth is necessary for adequately increasing the object's structural integrity. This structure for the split shell casing rotary drive and for the rotary driver results in a compact, modular apparatus which can be quickly and easily attached to an assembled split casing. Also, because of this structure, it is possible to fabricate a light weight apparatus which is manually portable by fabricating the split shell casing rotary drive and structural portions of the rotary driver from a light weight material such as a manganese aluminum alloy.

After the split casing has been assembled about the elongate object and driven into the ground about its subterranean portion in this manner using the combined split shell casing rotary drive and the rotary driver, an annulus exists between the pole and the casing. As with the prior split casing technique for pole repair, the method for reinforcing a pole disclosed herein is completed by filling this hollow annulus between the casing and the pole with material such as grout and sand.

An advantage of the present invention is that it provides an improved pole repair technique suitable for repairing lot line poles.

Another advantage of the present invention is that it provides an assembly for pole repair which can be made sufficiently light so that it can be manually carried as separate pieces to a pole repair site.

Another advantage of the present invention is that it provides an assembly for pole repair which may be quickly and easily assembled at a pole repair site.

Another advantage of the present invention is that it provides an apparatus for pole repair which may be made sufficiently light to allow manually carrying it to a pole repair site.

Another advantage of the present invention is that it provides a split casing for pole repair which may be installed about the subterranean portions of a pole with the application of only a small downward force urging it into the ground.

These and other features, objects and advantages will either be discussed or will, no doubt, become apparent to those of ordinary skill in the art after having read the following detailed description of the best modes for carrying out the invention as illustrated in the various drawing figures.

BEST MODES FOR CARRYING OUT THE INVENTION

Figure 1:
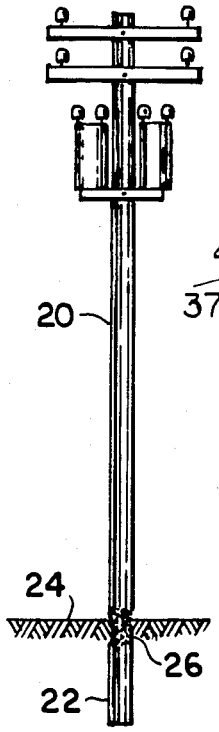
FIG. 1 is a diagramatic plan view showing utility pole embedded in the ground which depicts groundline rot.

Referring now to FIG. 1, depicted there is an upstanding, elongate object, in particular a utility pole 20 as may be used for supporting electrical power lines. The pole 20 has a subterranean portion 22 which is embedded into the ground 24. Also depicted in FIG. 1 on the pole 20 about the point along its length at which it enters the ground 24, i.e. about the pole's groundline, is a groundline rotted section 26. Various devices and methods for reinforcing poles 20 which have been weakened by groundline rot are described hereinabove such as those in the presently pending Patent Cooperation Treaty International Application No. PCT/US84/00043 entitled "Techniques for Establishing Inground Support Footings and for Strengthening and Stabilizing the Soil at Inground Locations" filed by Frank R. Kinnan on Jan. 16, 1984, which claimed the priority date of U.S. patent application Ser. No. 458,817 filed by Frank R. Kinnan on Jan. 18, 1983 which is presently assigned to the Electrical Power Research Institute of Palo Alto, Calif., and in the presently pending Patent Cooperation Treaty International Application No. PCT/US83/01878 entitled "Method and Apparatus for Installing an In-Ground Support Footing Around an Upstanding Elongate Object" filed by Frank R. Kinnan on Dec. 1, 1983 which is assigned to the assignee of the present application. The content of both these presently pending patent applications is incorporated herein by reference for completeness of the description set forth here.

Figure 2:
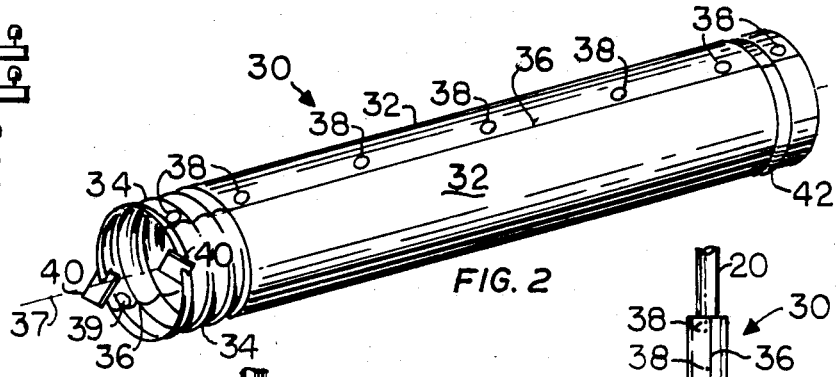
FIG. 2 is a diagramatic perspective view of a split casing as assembled from its partial cylinders in accordance with the present invention which has a toothed cutting means.

FIG. 2 depicts a split casing in accordance with the present invention referred to by the general reference number 30. The split casing 30 includes two partial cylinders 32 which are formed with helical threads 34 located about one of their terminal ends. The two partial cylinders 32 are formed as substantially identical, complementary half-cylinders respectively having identical radii and elongate longitudinal edges 36. The longitudinal edges 36 are shaped to overlap when the partial cylinders 32 are mated with their inner, concave surfaces facing together thus forming the split casing 30 about its longitudinal axis 37. A plurality of bolts 38, located at spaced positions along the length of the longitudinal edges 36 and secured through them into mating nuts 39 fastened to their inner surfaces, join the partial cylinders 32 into the unitary, hollow split casing 30. Secured at the end of each partial cylinder 32 projecting outward from the helical threads 34 is a tooth 40. A indented rib 42 is formed into the surface of each partial cylinder 32 near its end furthest from the helical threads 34 to maintain the cylindrical shape of the partial cylinder 32 after it has been formed from a flat sheet of material such as steel. For reinforcing common types of utility poles 20, the length of the split casing 30 may vary depending on the type of pole 20 or the length of the groundline rotted section 26 which may be present. A typical length is approximately 2.5 meters (8 feet) measured parallel to the longitudinal axis 37 of the split casing 30. The helical threads 34 generally have a length of approximately of 300 millimeters (1 foot) when measured along that same direction.

Figure 3:
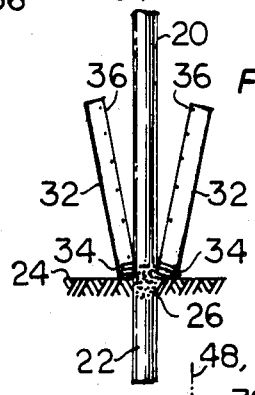
FIG. 3 is a diagramatic plan view showing assembly of the split casing of FIG. 2 about the immediately above-ground portion of the utility pole of FIG. 1 in accordance with the present invention.
Figure 4:
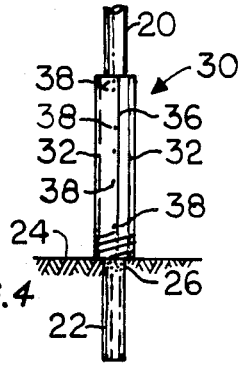
FIG. 4 is a diagramatic plan view showing the split casing after its assembly as depicted in FIG. 3 has been completed.

As depicted in FIG. 3, assembly of the split casing 30 about the above-ground portion of the pole 20 commences with positioning the partial cylinders 32 of the split casing 30 on opposite sides of the pole 20 with their respective helical threads 34 immediately adjacent to each other and contacting the ground 24, and with their concave inner surfaces generally directed toward the pole 20. The highest portions of the partial cylinders 32 are then raised toward the pole 20 as depicted by the arrows in FIG. 3 and the longitudinal edges 36 of the partial cylinders 32 are mated to form the split casing 30 about the pole 20 as depicted in FIG. 4. The bolts 38 are then secured through the overlapped longitudinal edges 36 of the partial cylinders 32 to complete assembly of the split casing 30. When thus assembled, the innermost, cylindrical surface of the split casing 30 encloses a hollow annulus 44, illustrated in FIG. 5, the inner surface of which is formed by the exterior surface of the pole 20, and the longitudinal axis 37 of the split casing 30 is generally collinear with the longitudinal axis 48 of the pole 20. Further, when the split casing 30 is disposed in this position, the tooth 40 of each partial cylinder 32 engages the ground 24 immediately surrounding the subterranean portion 22 of the pole 20. Thus, upon being assembled about the pole 20, the split casing 30 is completely prepared to be driven into the ground 24 surrounding the subterranean portion 22 by being rotated about its longitudinal axis 37. To facilitate driving the split casing 30 downward into the ground 24 as the split casing 30 is rotated about its longitudinal axis 37, each tooth 40 is secured to its respective partial cylinder 32 at an angle with respect to the the helical threads 34 which adapts the tooth 40 to assist the helical threads 34 cutting the soil and drawing the split casing 30 downward into the ground 24.

Figure 5:
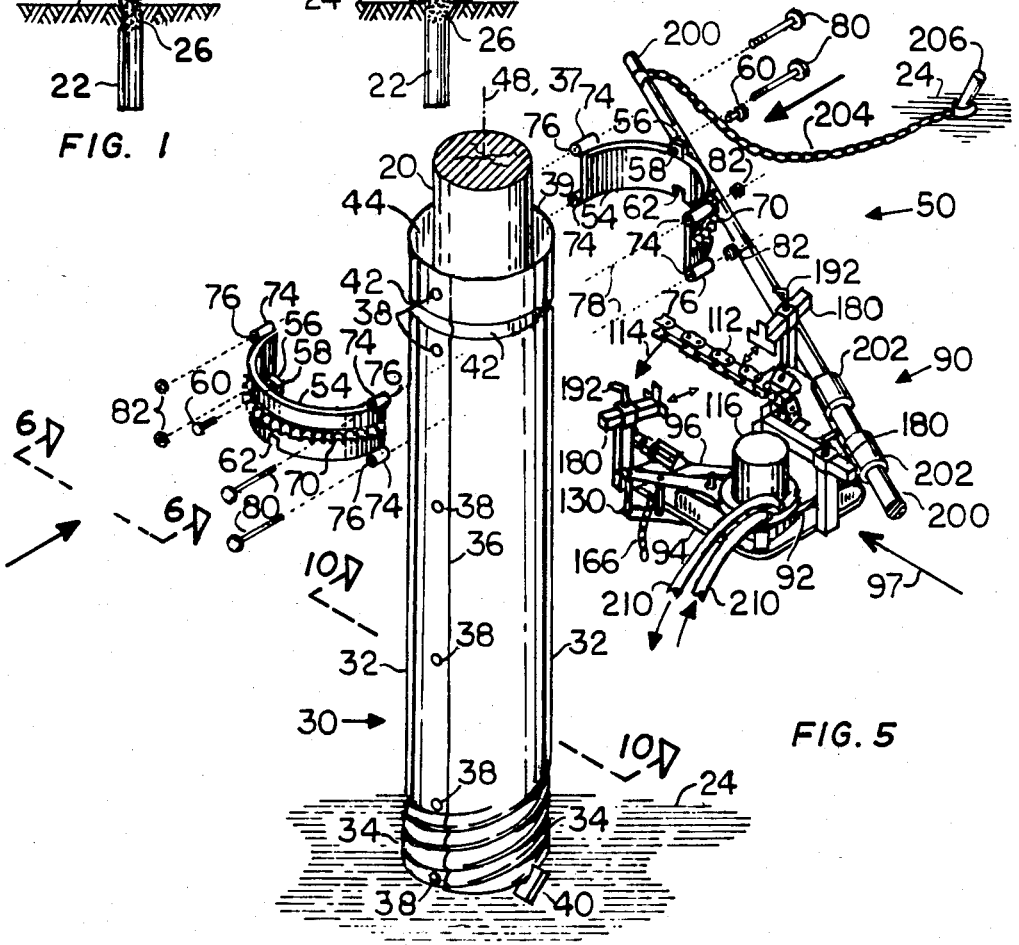
FIG. 5 is a diagramatic, exploded perspective view showing securing a split shell casing rotary drive to the assembled split casing of FIG. 4 and the mating, engaging and supporting of a rotary driver thereon in accordance with the present invention.

With the split casing 30 assembled about the pole 20 and thus completely prepared to be driven into the ground 24 about its subterranean portion 22, as depicted in FIG. 5 an apparatus referred to by the general reference character 50 in accordance with the present invention is secured about the highest end of the split casing 30 for rotating the split casing 30 about its longitudinal axis 37. The apparatus 50 includes a split shell casing rotary drive 52 which is assembled about the upper end of the split casing 30 by fastening a pair of identical, semicircular, cylindrical shells 54 on diametrically opposite sides of the split casing 30. Each shell 54 is respectively centered about one of the diametrically opposed longitudinal edges 36 of the partial cylinders 32. To rigidly secure the split shell casing rotary drive 52 to the split casing 30, each shell 54 includes an upwardly projecting tab 56 centrally located along its circumference. Each tab 56 has an aperture 58 formed through it to receive a mounting bolt 60 which engages the highest nut 39 of the split casing 30 for rigidly securing the shell 54 to the split casing 30. Each shell 54 also includes an upwardly projecting notch 62 formed into the lower surface of the shell 54 about the center of its circumference. The notches 62 in the shells 54 receive the heads of the next to the highest bolts 38 joining the partial cylinders 32 together to form the split casing 30. The combined mounting bolts 60 fastened through the tabs 56 and the heads of the bolts 38 received into the notches 62 rigidly lock the split shell casing rotary drive 52 and the split casing 30 together so they must move in unison.

Projecting radially outward from the outer surface of each shell 54 about the midpoint of its vertical height is a semicircular sprocket segment 70. To permit establishing a continuous sprocket 72 encircling the split casing 30 in a plane perpendicular to and centered about the longitudinal axis 37 of the split casing 30 from this pair of semicircular sprocket segments 70, each shell 54 includes two pairs of ears 74 which respectively project outward from the highest and lowest edges of the diametrically opposed ends of the shells 54. Formed through each ear 74 is an aperture 76 having a longitudinal axis 78 which may be aligned collinear with that of the aperture 76 of the immediately adjacent ear 74 located on the other shell 54. Thus when the shells 54 are rigidly locked to the split casing 30, the apertures 76 in each immediately adjacent pair of ears 74 are aligned to establish a single continuous aperture through which the threaded end of a clamping bolt 80 is inserted to mate with a clamping nut 82. When thus inserted through a pair of apertures 76 formed through the ears 74 and secured there by the clamping nut 82, the clamping bolts 80 bind the adjacent ends of the,shells 54 together thereby forming the semicircular sprocket segments 70 into the continuous sprocket 72. This binding together of the ends of the shells 54 after they have been rigidly locked to the split casing 30 with the mounting bolts 60 completes assembly of the split shell casing rotary drive 52 about the upper end of the split casing 30.

In addition to the split shell casing rotary drive 52, the apparatus 50 also includes a rotary driver in accordance with the present invention referred to by the general reference character 90 which mates with, engages, and is supported upon the split shell casing rotary drive 52. The rotary driver 90 includes an upper plate 92 rigidly joined to, spaced apart from, and held parallel to a lower plate 94 by a plurality of spacer blocks 95 located on the outer periphery of the plates 92 and 94 as is most clearly illustrated in FIG. 8. Each of the plates 92 and 94 is formed with a U-shaped edge 96 adapted to pass around the assembled split shell casing rotary drive 52 as secured to the split casing 30 when the rotary driver 90 is moved inward toward the pole 20 as indicated by the arrow 97 in FIG. 5. When the rotary driver 90 is thus mated with the split shell casing rotary drive 52 with the plates 92 and 94 respectively located above and below the sprocket 72 as depicted in FIG. 6, the U-shaped edge 96 is immediately adjacent to but does not contact the outer surface of the split shell casing rotary drive 52.

Figure 7:
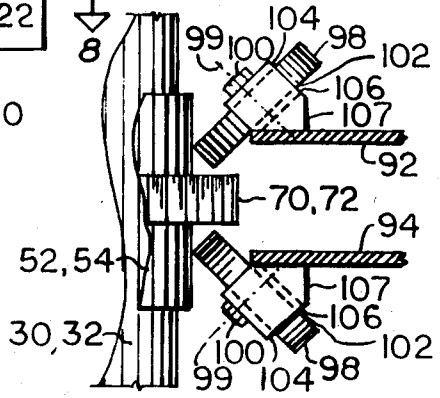
FIG. 7 is a diagramatic plan view showing the mating and support of the rotary driver upon the split shell casing rotary drive taken along the line 7—7 of FIG. 6.
Figure 6:
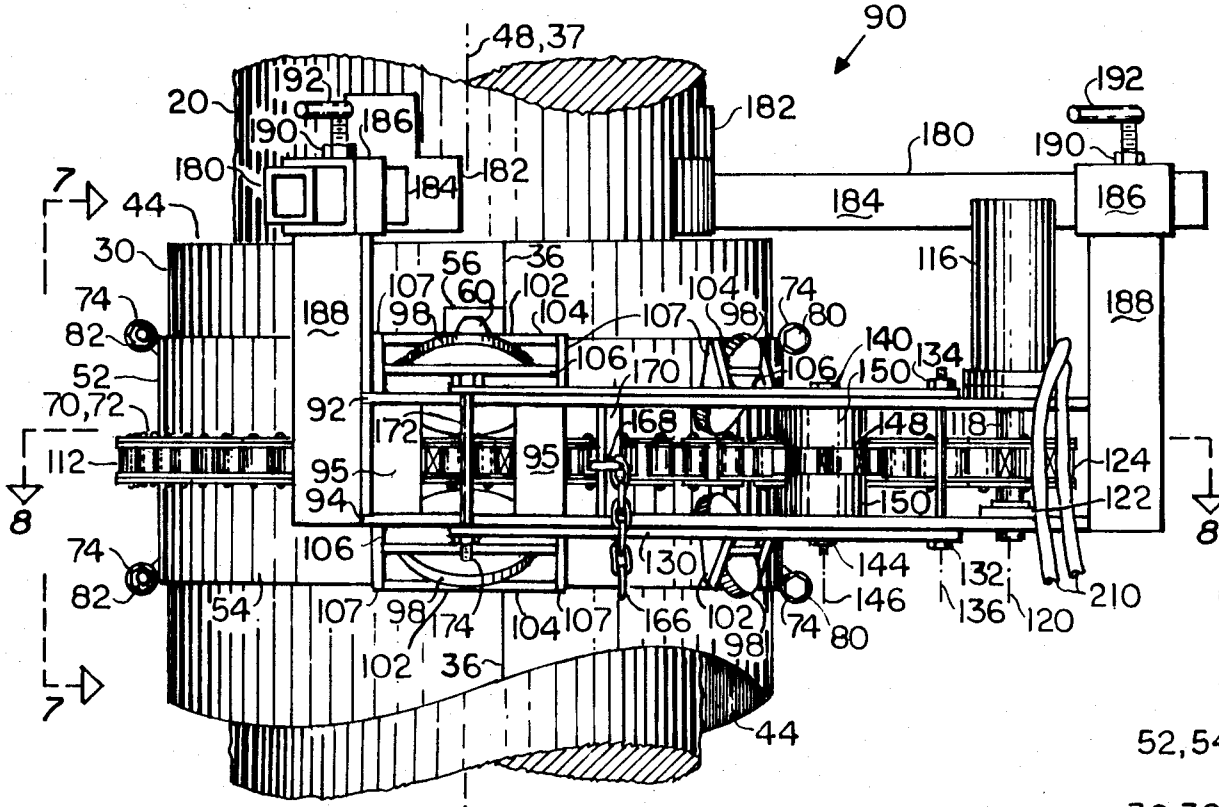
FIG. 6 is a diagramatic plan view showing the assembled split casing, split shell casing rotary drive, and rotary driver taken along the line 6—6 of FIG. 5.
Figure 8:
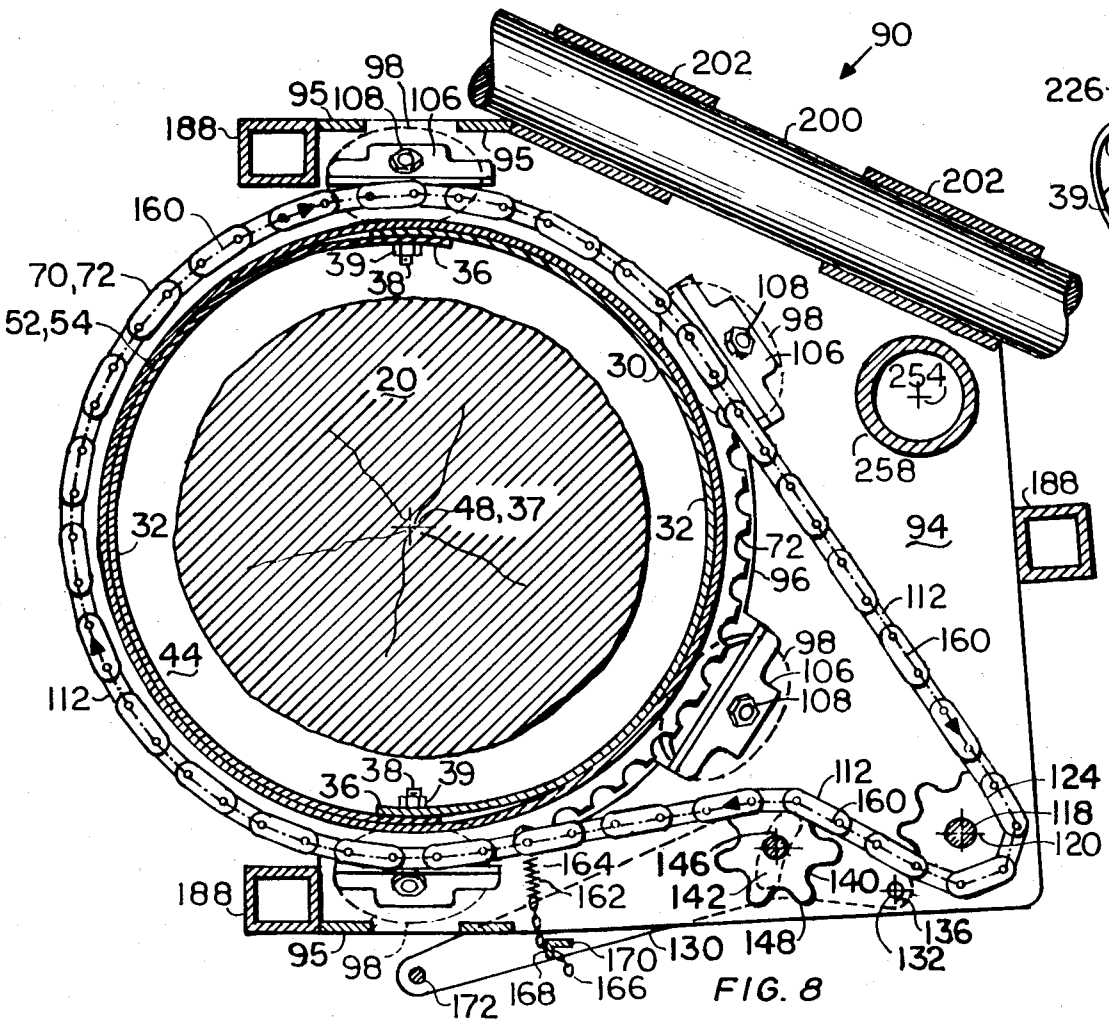
FIG. 8 is a cross-sectional view illustrating the assembled split casing, split shell casing rotary drive, and rotary driver taken along the line 8—8 of FIG. 6.

Referring now to FIGS. 6 and 8, the rotary driver 90 also includes four pairs of guide wheels 98 spaced uniformly along the semicircular segment of the U-shaped edge 96 of the plates 92 and 94 immediately adjacent to the split shell casing rotary drive 52. One guide wheel 98 of each such pair is respectively secured to the upper plate 92 while the other is secured to the lower plate 94. As most clearly depicted in FIG. 7, each guide wheel 98 is secured to be rotatable about an axis 99 disposed at an angle with respect to the plane of the sprocket 72 by being mounted on an axle bolt 100 passing through the center of the guide wheel 98. Each axle bolt 100 is secured to the rotary driver 90 by a wheel mounting block 102 which is attached either to the upper plate 92 or to the lower plate 94. To secure the axle bolt 100, each wheel mounting block 102 includes an outer plate 104 and an inner plate 106 through which the axle bolt 100 passes. The plates 104 and 106 are respectively located on opposite sides of and parallel to the guide wheel 98 and are supported between two triangularly shaped end plates 107. A wheel nut 108 as shown in FIG. 8, located on the side of the inner plate 106 furthest from the guide wheel 98, secures the axle bolt 100 within the wheel mounting block 102. Thus rotatably secured to the rotary driver 90, each pair of guide wheels 98 is arranged in the shape of the letter "V" opening outward from the split shell casing rotary drive 52 with the vertex of their V-shape located at the surface of the split shell casing rotary drive 52 from which the sprocket 72 projects, the V-shape being positioned symmetrically about the plane of the sprocket 72. Therefore, when the rotary driver 90 is mated with the split shell casing rotary drive 52, one of the guide wheels 98 in each pair engages the split shell casing rotary drive 52 about the junction between its vertical outer surface and the upper surface of the sprocket 72 while the other guide wheel 98 in each pair engages the split shell casing rotary drive 52 about the junction between its vertical outer surface and the lower surface of the sprocket 72. This engagement between the guide wheels 98 and the split shell casing rotary drive 52 supports the rotary driver 90 on the split shell casing rotary drive 52 while allowing facile rotary motion between the split casing 30 and the rotary driver 90 about the longitudinal axis 37.

Referring again to FIG. 5, the rotary driver 90 also includes a length of drive chain 112 which is left open while the rotary driver 90 is being mated with the split shell casing rotary drive 52. After the rotary driver 90 has been engaged with the split shell casing rotary drive 52 so the guide wheels 98 contact it on both sides of the sprocket 72, the drive chain 112 is closed into a continuous loop about and mated with the sprocket 72 as illustrated by the curved arrow 114. Upon fastening the ends of the drive chain 112 together, the drive chain 112 encircling the sprocket 72 secures the rotary driver 90 to the split shell casing rotary drive 52.

Referring once again to FIGS. 6 and 8, the rotary driver 90 includes a hydraulic motor 116 which projects upward above the upper plate 92. The hydraulic motor 116 includes a drive shaft 118 which is rotatable about about an axis 120 aligned substantially parallel to the longitudinal axis 37 of the split casing 30 when the rotary driver 90 is mated with the split. shell casing rotary drive 52. The drive shaft 118 projects downward out of the hydraulic motor 116 through the upper plate 92 and is rotatably supported at its lower end by a bearing 122 secured to the lower plate 94. Secured to the drive shaft 118 along its length extending between the plates 92 and 94 at a location coplanar with the sprocket 72 is a drive sprocket 124.

The rotary driver 90 also includes a pair of curved chain tension arms 130 respectively located above and below the plates 92 and 94. The chain tension arms 130 are secured to the rotary driver 90 by a tension arm pivot bolt 132 which extends upward through the lower chain tension arm 130, the lower plate 94, the upper plate 92, and the upper chain tension arm 130 to mate with a nut 134. Thus the tension arm pivot bolt 132 provides an axis 136 about which the chain tension arms 130 may rotate. Also extending upward between the chain tension arms 130 is an idler sprocket axle bolt 140 which passes through identical arcuate apertures 142 formed respectively through both the plates 92 and 94 and is secured in that position by a nut 144. The edges of the arcuate apertures 142 immediately adjacent to the idler sprocket axle bolt 140 are formed as segments of circles centered about the axis 136. Thus the idler sprocket axle bolt 140 may move freely throughout length of the arcuate apertures 142 as the chain tension arms 130 rotates about the tension arm pivot bolt 132. Supported by the idler sprocket axle bolt 140 to be rotatable about an axis of rotation 146 aligned substantially parallel to the longitudinal axis 37 and the axis 120 is an idler sprocket 148. Spacer washers 150, located respectively on both sides of the idler sprocket 148, maintain it in a location lying between the plates 92 and 94 in the same plane as that of the sprocket 72 and the drive sprocket 124.

With the rotary driver 90 mated with and engaging the split shell casing rotary drive 52 and the drive chain 112 closed into a continuous loop about the sprocket 72, the sprockets 72, 124, and 148 establish a drive chain path 160 lying substantially in the plane of the sprocket 72 along which the drive chain 112 is guided. More specifically, the drive chain path 160 for the drive chain 112 encloses both the sprocket 72 and drive sprocket 124 while the idler sprocket 148 lies outside the drive chain path 160. Thus with the idler sprocket 148 disposed outside the drive chain path 160, a proper tension may be maintained in that portion of the drive chain 112 disengaged from the sprocket 72 by urging the idler sprocket 148 inward toward the area enclosed by the drive chain path 160. A force urging the idler sprocket 148 inward toward the area enclosed by the drive chain path 160 is coupled from a chain tension coil spring 162 to the idler sprocket 148 by the chain tension arms 130. The end of the chain tension coil spring 162 closest to the drive chain path 160 is secured to a mounting block 164 supported between the upper plate 92 and the lower plate 94. The end of the chain tension coil spring 162 furthest from the drive chain path 160 is connected to a tension adjustment chain 166 which is secured along its length into a notch 168 formed into a tension adjustment block 170 supported between the chain tension arms 130. Thus tension in the chain tension coil spring 162 is coupled by the tension adjustment chain 166 and the tension adjustment block 170 to the chain tension arms 130 to apply a force which urges the chain tension arms 130 together with the idler sprocket 148 to rotate inward about the axis 136 toward the area enclosed by the drive chain path 160. To facilitate establishing and adjusting the amount of force applied by the chain tension coil spring 162 to the idler sprocket 148, a handle bolt 172 spans between the ends of the chain tension arms 130 furthest from the tension arm pivot bolt 132 and is secured in that position by a nut 174.

After the rotary driver 90 has been thus mated and engaged with the split shell casing rotary drive 52 and the tensioned drive chain 112 engaged with the sprocket 72, three pole guides 180 included in the rotary driver 90 may be adjusted inward to contact the exterior surface of the pole 20, as illustrated by the double headed arrows in FIG. 5. The pole guides 180 are adjusted so as to align the longitudinal axis 37 of the split casing 30 generally collinear with the longitudinal axis 48 of the pole 20. Each pole guide 180 includes a curved, T-shaped guide plate 182 located immediately adjacent to the exterior surface of the pole 20 which is attached to one terminal end of a hollow, square-shaped horizontal rod 184. Each horizontal rod 184 of the pole guide 180 extends through a hollow, square-shaped pole guide clamp 186 located at the highest end of a pole guide support column 188. The lower end of each pole guide support column 188 is rigidly attached to both the upper plate 92 and the lower plate 94 for supporting the pole guide 180. Attached to the upper surface of each pole guide clamp 186 is a clamping nut 190 which receives the threaded end of an L-shaped clamping screw 192. Thus, after the pole guides 180 have been adjusted inward to contact the exterior surface of the pole 20, they are locked in that position with the clamping screw 192.

Referring again to FIG. 5, after the pole guides 180 have been adjusted inward to contact the exterior surface of the pole 20 for aligning the longitudinal axis 37 of the split casing 30 generally collinear with the longitudinal axis 48 of the pole 20, one end of an elongated, telescoping restraining pole 200 is inserted through two collinear restraining pole guides 202 rigidly attached to the side of the rotary driver 90 between the plates 92 and 94. One end of a chain 204 is secured to the end of the restraining pole 200 furthest from the rotary driver 90 to prevent it from rotating about the longitudinal axis 37 of the split casing 30 when the hydraulic motor 116 is energized. Consequently, the other end of the chain 204 is secured to the ground 24 in some manner such as by attaching it to the base of a stake 206 driven into the ground 24.

After the rotary driver 90 has been secured to the ground 24 surrounding the subterranean portion 22 of the pole 20 to prevent the rotary driver 90 from rotating about the longitudinal axis 37 of the split casing 30, the hydraulic motor 116 is energized by initiating a flow of hydraulic fluid through a pair of hydraulic hoses 210 attached to the hydraulic motor 116 as illustrated by the immediately adjacent pair of opposed arrows in FIG. 5. Applying this flow of hydraulic fluid to the hydraulic motor 116 causes it to apply a torque to the drive sprocket 124 urging it to rotate clockwise when viewed from above looking downward toward the ground 24 along the longitudinal axis 48 of the pole 20 as illustrated by the curved arrow in FIG. 8. The torque applied to the drive sprocket 124 in turn applies a force to the drive chain 112 urging it to travel along the drive chain path 160 in a clockwise direction about the area enclosed by the drive chain path 160 as illustrated by the arrows along the drive chain path 160 in 8. This force applied to the drive chain 112 is coupled to the sprocket 72 of the split shell casing rotary drive 52 and thereby urges the split casing 30 to which it is rigidly locked to rotate about its longitudinal axis 37. The action of the helical threads 34 and the teeth 40 at the lower end of the rotating split casing 30 contacting the ground 24 cause the split casing 30 to be drawn downward into the ground 24 surrounding the subterranean portion 22.

Figure 10:
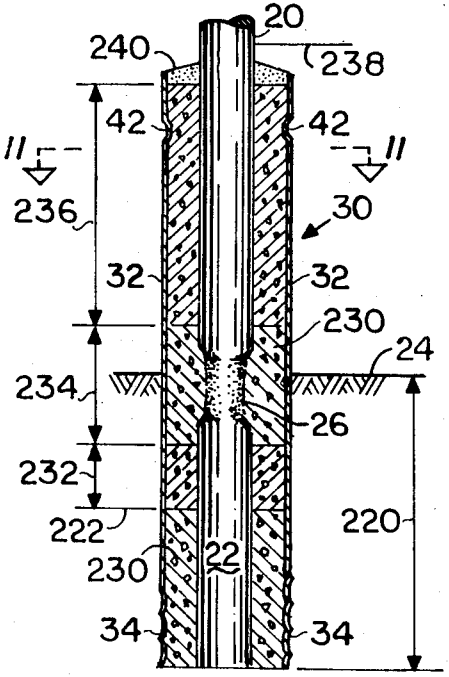
FIG. 10 is a cross-sectional view illustrating an assembled split casing taken along the line 10—10 of FIG. 5 after the casing has been driven into the ground about the pole and the annulus between the pole and the split casing has been filled with material such as grout and sand to complete the pole's reinforcement.
Figure 11:
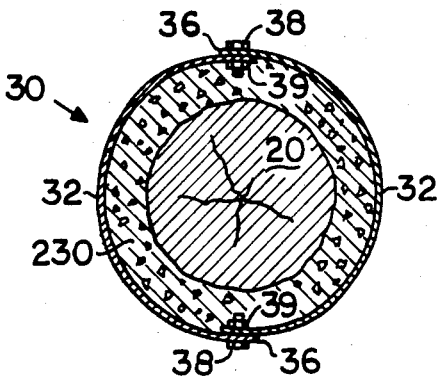
FIG. 11 is a diagramatic cross-sectional view of a reinforced pole, taken along the line 11—11 of FIG. 10.

Referring now to FIGS. 10 and 11, rotation of the split casing 30 about its longitudinal axis 37 is continued until the lower end of the split casing 30 penetrates the ground 24 to a preestablished depth indicated by the double headed arrow 220. Generally the split casing 30 is driven into the ground 24 so the lower edge of the helical threads 34 is at the same depth as the bottom of the subterranean portion 22 of the pole 20. A typical penetration depth for the split casing 30 is 1.0 to 1.25 meters (3 to 4 feet). After that depth has been reached, the flow of hydraulic fluid is stopped because installation of the split casing 30 has now been completed. With the split casing 30 now installed in the ground 24, the rotary driver 90 is first removed from the split shell casing rotary drive 52 after which the mounting bolts 60 and the shells 54 are removed from the split casing 30. Then the highest bolts 38 are inserted through the longitudinal edges 36 of the partial cylinders 32 and secured into the highest nuts 39.

Figure 9:
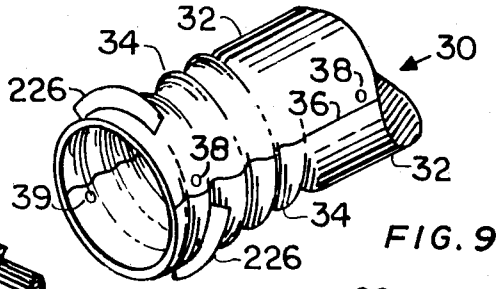
FIG. 9 is a diagramatic perspective view of one end of a split casing as depicted in FIG. 2 having an arcuate rib cutting means.

In some types of soil conditions, as the split casing 30 descends into the ground 24 the action of the rotating helical threads 34 alone, without the teeth 40, is sufficient to move soil outward from the exterior surface of the pole 20 and compact it about the outer surface of the split casing 30 thereby extending the hollow annulus 44 downward into the ground 24 to the depth of the line 222, generally about 460 millimeters (18 inches). In other types of soil conditions, obtaining such an extension of the hollow annulus 44 downward into the ground 24 requires both the helical threads 34 and the teeth 40 to effectively cut the soil and draw the split casing 30 downward into the ground 24. Alternatively, embedding the split casing 30 into a different type of soil may be assisted by adding an arcuate rib 226 projecting outward from the outermost crests of the helical threads 34 of the partial cylinder 32 either with or without the teeth 40 as depicted in FIG. 9. In yet other soil conditions, the action of the rotating helical threads 34 combined with both the teeth 40 and the arcuate rib 226 may be insufficient to extend the hollow annulus 44 downward into the ground 24 to this depth as is essential for properly reinforcing the groundline rotted section 26 of the pole 20. In the instance of this latter soil condition, prior to assembling the partial cylinders 32 to form the split casing 30, the ground 24 immediately surrounding the pole 20 must be prepared by manually digging downward along the subterranean portion 22 to the depth of the line 222.

With the split casing 30 installed about the pole 20 and the annulus 44 extending downward into the ground 24 to the depth of the line 222, the pole 20 is now prepared for the final operation of the reinforcement process, placing a filler material 230 into the annulus 44 between the interior surface of the split casing 30 and the exterior surface of the pole 20. The preferred manner in which the filler material 230 is placed into the annulus 44 begins with first filling the lower section of the annulus 44 with pea gravel throughout a height of approximately 300 millimeters (1 foot) above the line 222 as indicated by the arrow 232. Then approximately 2 liters (½ gallon) of an epoxy resin, which may also include a time-release fungicide to suppress further decay of the reinforced pole 20, is distributed evenly over the upper surface of the pea gravel. The resin-aggregate mixture thus formed is then tamped to assure thorough permeation of the resin throughout the aggregate. After the lower section of the annulus 44 has been thus filled, the section immediately above it is filled with pea gravel to a height of approximately 150 millimeters (6 inches) above the surface of the ground 24 as indicated by the arrow 234. Again approximately 2 liters (½ gallon) of an epoxy resin, which again may also include a time-release fungicide to suppress further decay of the reinforced pole 20, is distributed evenly over the upper surface of the pea gravel and this resin-aggregate mixture is again tamped to assure thorough permeation of the resin throughout the aggregate. Then the remaining upper section of the annulus 44 is filled with pea gravel to approximately 75 millimeters (3 inches) below the upper edge of the split casing 30 as indicated by the arrow 236. A final quantity of approximately 2 liters (½ gallon) of an epoxy resin, which again may also include a time-release fungicide to suppress further decay of the reinforced pole 20, is distributed evenly over the upper surface of the pea gravel and this resin-aggregate mixture is again tamped to assure thorough permeation of the resin throughout the aggregate. The outer surface of the pole 20 immediately above the upper surface of the resin-aggregate filler material 230 is then coated with epoxy resin to a height approximately 140 millimeters (6 inches) above the upper edge of the split casing 30 which is indicated by the line 238. Then an epoxy resin-sand mixture, which may also include a time-release fungicide to suppress further decay of the reinforced pole 20, is placed into the remaining upper length of the split casing 30 about the resin coated portion of the pole 20. This resin-sand mixture is shaped to form a beveled water shedding surface 240 sloping upward from the top edge of the split casing 30 to a height on the pole 20 approximately 75 millimeters (3 inches) above that edge. After the annulus 44 has been thus filled with the filler material 230 and the epoxy resin cures, the pole 20 is then reinforced by a support footing which restores it substantially to its original strength.

Figure 12:
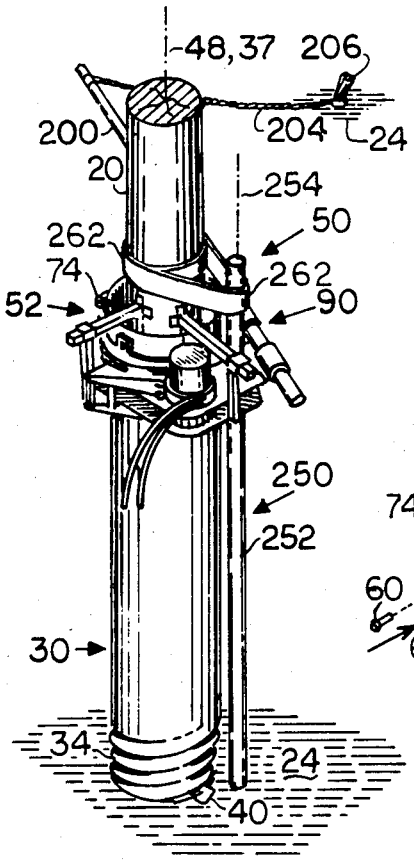
FIG. 12 is a diagramatic perspective view showing an assembled split casing, split shell casing rotary drive, and rotary driver as depicted in FIG. 5 which further includes a longitudinal guide for establishing and maintaining the split casing's longitudinal axis generally parallel to that of the elongate object which it surrounds.

Referring now to FIG. 12, depicted there is an assembled split casing 30 about the upper end of which is attached the apparatus 50 including the split shell casing rotary drive 52 and rotary driver 90. Installed alongside the split casing 30 is a longitudinal guide in accordance with the present invention referred to by the general reference character 250 for establishing and maintaining the longitudinal axis 37 of the split casing 30 generally parallel to the longitudinal axis 48 of the pole 20. The longitudinal guide 250 includes a guide pole 252 having its lower end embedded into the ground 24 surrounding the subterranean portion 22 and its longitudinal axis 254 aligned substantially parallel to the longitudinal axis 37 of the split casing 30. The guide pole 252, which may be assembled from a plurality of shorter sections, must have a length greater than the height of the split casing 30. Referring again to FIG. 8, the rotary driver 90 is adapted to engage the guide pole 252 and to slide downward along its length as the split casing 30 is driven into the ground 24 by the inclusion in the rotary driver 90 of a hollow cylindrical guide 258 which is secured between its upper plate 92 and lower plate 94. Thus, if the longitudinal guide 250 is to be used in conjunction with the apparatus 50 while the split casing 30 is being driven into the ground 24, the guide pole 252 must be inserted through the hollow center of the cylindrical guide 258 before it is embedded into the ground 24. Referring again to FIG. 12, the longitudinal guide 250 also includes a triangularly shaped pole clamp 262 which is rigidly secured to the pole 20 above the upper edge of the split casing 30 and to the guide pole 252 about its highest end. With the longitudinal guide 250 thus installed alongside the split casing 30, as the split casing 30 cuts the soil and draws itself downward into the ground 24, the cylindrical guide 258 secured between the plates 92 and 94 of the rotary driver 90 slides downward around the guide pole 252. Thus by the sliding engagement between the cylindrical guide 258 and the guide pole 252 the longitudinal axis 37 of the split casing 30 is maintained generally parallel to the longitudinal axis 48 of the pole 20.

Figure 13:
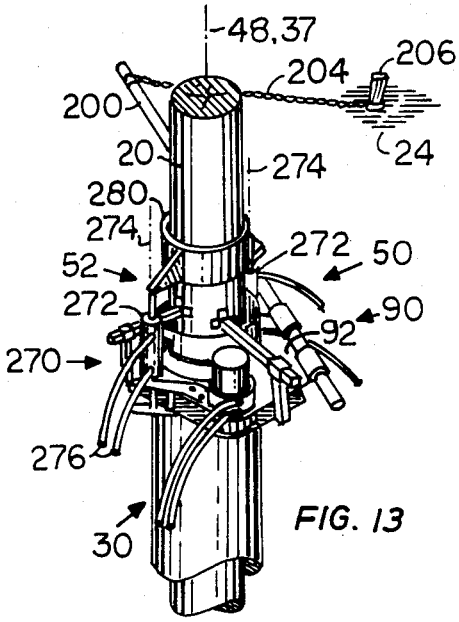
FIG. 13 is a diagramatic perspective view showing an assembled split casing, split shell casing rotary drive, and rotary driver as depicted in FIG. 5 which further includes a longitudinal driver for applying a downward force to the split casing.

Referring now to FIG. 13, also depicted there is an assembled split casing 30 about the upper end of which is attached the apparatus 50 including the split shell casing rotary drive 52 and rotary driver 90. Installed about the upper end of the split casing 30 is a longitudinal driver in accordance with the present invention referred to by the general reference character 270 for for applying a force directed downward along the longitudinal axis 37 of the rotating split casing 30 as it cuts the soil and draws itself downward into the ground 24. The longitudinal driver 270 includes a pair of hydraulic cylinders 272 which are both located above the upper plate 92 of the rotary driver 90 and respectively located on diametrically opposite sides of the split casing 30. The hydraulic cylinders 272 are oriented so their axes 274 of extension and retraction are aligned substantially parallel to the longitudinal axis 37 of the split casing 30. A pair of hydraulic hoses 276 are connected to each hydraulic cylinder 272 for applying a flow of hydraulic fluid to the hydraulic cylinders 272. Depending upon the direction of flow through the hydraulic hoses 276, the hydraulic cylinders 272 will either extend or retract along the axes 274. The base of each hydraulic cylinder 272 is secured to the upper surface of the upper plate 92. The highest end of each hydraulic cylinder 272 is rigidly secured to diametrically opposite sides of a yoke 280 which is rigidly secured to the pole 20 above the highest edge of the split casing 30. When the yoke 280 is secured to the pole 20 before the hydraulic motor 116 is energized to commence driving the split casing 30 into the ground 24, the hydraulic cylinders 272 are fully retracted. After the hydraulic motor 116 is energized and the split casing 30 commences rotating, the hydraulic cylinders 272 are also energized to apply a force to the split casing 30 through the rotary driver 90 which is directed downward along the longitudinal axis 37 of the split casing 30.

INDUSTRIAL APPLICATION

The structure of the apparatus 50 of the present invention provides a compact, modular unit which can be made sufficiently light to be manually portable by fabricating selected portions of the split shell casing rotary drive 52 and the rotary driver 90 from a light weight material such as a manganese aluminum alloy. In particular such a portable apparatus 50 may be achieved by casting both shells 54 of the split shell casing rotary drive 52 and the assembly formed by the plates 92 and 94, spacer blocks 95, wheel mounting blocks 102, pole guide clamps 186 and pole guide support columns 188, restraining pole guides 202 and cylindrical guide 258 from such an alloy. An additional weight reduction may be achieved by also fabricating the assembly of the chain tension arms 130, tension adjustment block 170, and handle bolt 172 and the assembly of the guide plate 182 and horizontal rod 184 from a light weight alloy.

Figure 14:
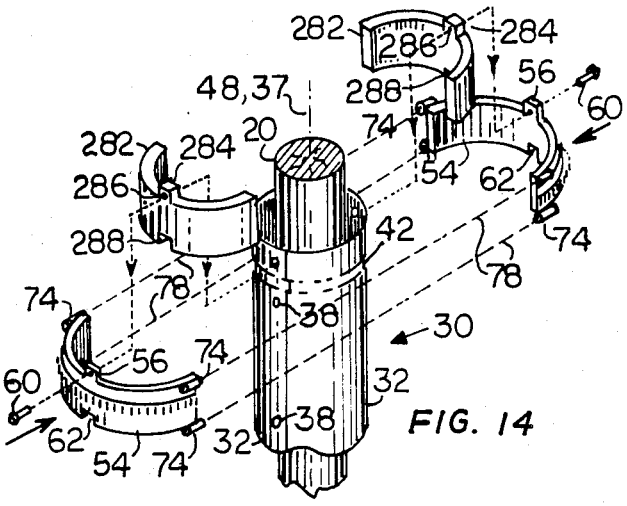
FIG. 14 is a diagramatic, exploded perspective view showing a split shell casing rotary drive being secured to the assembled split casing of FIG. 4 about a cylindrically shaped adapter which fills an annular space between the inner surface of the split shell casing rotary drive and the outer surface of the split casing.

Utility poles 20 having different diameters are generally used depending upon the particular type of power line to be supported. For example, poles 20 used to support distribution power lines generally have a diameter between 350 and 400 millimeters (14 and 16 inches). Alternatively, poles 20 used to support transmission power lines generally have a diameter between 530 and 610 millimeters (21 and 24 inches). Because properly reinforcing the pole 20 requires that the annulus 44 provide only sufficient space between the pole 20 and the split casing 30 to allow easy placement of the filler material 230, it is desirable that the apparatus 50 should be easily adapted for installing split casings 30 of different diameters to permit minimizing the quantity of filler material 230 required for each diameter of pole 20. The apparatus 50 of the present invention may be easily adapted for different diameter split casings 30 in two different ways. First, different sized split shell casing rotary drives 52 may be used, each size of split shell casing rotary drive 52 having the same diameter for the sprocket 72 and a different diameter for its inner surface which mates with the outer surface of the split casing 30. Alternatively, only one size of split shell casing rotary drive 52 need be employed which fits the largest diameter split casing 30. Then, as depicted in FIG. 14, for split casings 30 having a smaller outer diameter a pair of cylindrically shaped adapters 282 having an appropriate wall thickness may be installed between the split shell casing rotary drive 52 and the split casing 30. Each cylindrically shaped adapter 282 includes an upwardly projecting tab 284 centrally located along its circumference through which an aperture 58 is formed to receive the mounting bolt 60 securing the shells 54 to the split casing 30. Each cylindrically shaped adapter 282 also includes an upwardly projecting notch 288 formed into its lower surface about the center of its circumference. The notch 288 in each cylindrically shaped adapter 282 receives the head of one of the next to the highest bolts 38 joining the partial cylinders 32 together to form the split casing 30. The combined mounting bolts 60 fastened through both the tabs 56 and 284 and the heads of the bolts 38 received into the notches 288 rigidly lock the split shell casing rotary drive 52 to the split casing 30 so they must move in unison.

Figure 15:
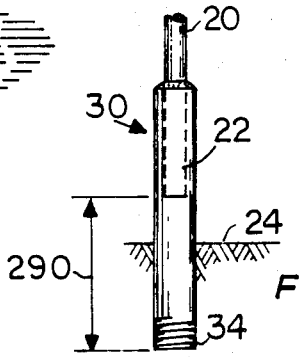
FIG. 15 is a diagramatic plan view depicting a pole raised to a higher elevation using a split casing, split shell casing rotary drive, rotary driver, and longitudinal driver.

While it is intended that the apparatus 50 of the present invention will be used principally for driving split casings 30 into the ground 24 solely for reinforcing poles 20, the apparatus 50 when used in conjunction with the longitudinal driver 270 may be employed to raise the height of an existing pole 20 after the split casing 30 is installed in the ground but before the annulus 44 is filled with the filler material 230. Referring now to FIG. 15, depicted there is a pole 20 which has been raised to a higher elevation after the split casing 30 was driven into the ground 24. Such a raising of the pole 20 may be achieved by appropriately securing the yoke 280 to the pole 20 with the hydraulic cylinders 272 fully retracted. After the yoke 280 has been secured, the hydraulic cylinders 272 are energized without energizing the hydraulic motor 116. Because the split casing 30 is stationary rather than rotating, the force applied by the hydraulic cylinders 272 will urge the pole 20 to raise upward rather than driving the split casing 30 downward into the ground 24. After the pole 20 has been raised a preestablished distance 290 indicated by the double headed arrow in FIG. 15 filler material 230 is placed into the annulus 44 in an analogous manner to that described above.

Various alternative ways of providing a flow of hydraulic fluid necessary for energizing the apparatus 50 of the present invention are readily apparent. When used in an urban environment, a hydraulic pump may be mounted on a vehicle which is parked on a street close to the pole 20 being restored. Then flexible hoses may be connected between such a pump and the apparatus 50. Alternatively, such a pump may be mounted on wheeled vehicle such as a tractor which is narrow enough to be driven through ordinary gates to reach the site of the pole 20. Finally, such a pump may be combined with an internal combustion engine to assemble a portable hydraulic power source which may be carried to the site of the pole 20.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. An apparatus for installing an inground support footing around the subterranean portion of an upstanding, elongate object, such as a structural pole, post or the like and around the immediately adjacent above-ground portions thereof, for increasing the object's structural integrity, by driving a hollow, cylindrical casing means into the ground to a preestableshed depth about the subterranean portion of the elongate object, said casing means surrounding the elongate object and having its central, cylindrical longitudinal axis aligned generally parallel to the elongate object's longitudinal axis, said casing means being formed with a cutting means located at one end thereof which cutting means end of said casing means is prepositioned concentrically around the immediately above-ground portion of the elongate object with the casing's cutting means engaging the ground, said apparatus comprising:

split casing rotaty drive means as may be rigidly locked circumferentially about said casing means for coupling a torque to said casing means, which torque urges said casing means to rotate about its longitudinal axis;

rotary driver means as may mate with, engage and be supported upon said split casing rotary drive means for applying a torque thereto whereby said casing means may be urged to rotate about its longitudinal axis and to be thereby driven into the ground to a preestablished depth about the subterranean portion of the elongate object; and wherein said split casing rotary drive means includes a plurality of mating, arcuate shaped shells which upon being assembled together may be locked circumferentially about and encircle said casing means, the outer, circumferential surface of said assembled shells furthest from said casing means being adapted to mate with, engage, and support said rotary driver means for applying torque to said split casing rotary drive means.

2. The apparatus of claim number 1 wherein the outer, circumferential surface of said assembled shells of said split casing rotary drive means encircling said casing means, which surface is adapted to mate with, engage, and support said rotary driver means, establishes a circular sprocket which encircles said casing means in a plane substantially perpendicular to the longitudinal axis of said casing means and which circular sprocket is centered about the longitudinal axis of said casing means, and wherein said rotary driver means includes:

guide means which may engage the outer surface of split casing rotary drive means for supporting said rotary driver means upon said split casing rotary drive means and maintaining said split casing rotary drive means in alignment with the circular sprocket of said split casing rotary drive means as said split casing rotary drive means together with said casing means is rotated with respect to said rotary driver means about said casing means's longitudinal axis;

a drive chain having sufficient length that upon being formed into a closed loop encircling the assembled shells of said split casing rotary drive means the drive chain mates with and engages the circular sprocket thereof along only a segment of the circular sprocket's circumference;

drive chain guide means for establishing a path along which that portion of the drive chain's length disengaged from the circular sprocket of said split casing rotary drive means is guided, the path thus established by the drive chain guide means being disposed substantially in the plain established by the circular sprocket of the split casing rotary drive means;

tensioning means for maintaining tension in the portion of the drive chain's length disengaged from the circular sprocket of said split casing rotary drive means;

energizing means for urging the drive chain to move along the path established by the drive chain guide means whereby said casing means may be urged to rotate about its longitudinal axis with respect to said rotary driver means; and restraining means for preventing said rotary driver means from rotating about the longitudinal axis of said casing means with respect to the ground surrounding the subterranean portion of the elongate object when the energizing means urges the drive chain to move along the path established by the drive chain guide means.

3. The apparatus of claim number 2 wherein the energizing means of said rotary driver means is an hydraulic motor.

4. The apparatus of claim number 1 further comprising pole guide means secured to said rotary driver means which pole guide means project inward above the uppermost edge of said casing means along radii projecting from said casing means's longitudinal axis, said pole guide means being adjustable with respect to the rotary driver means for permitting their extension inward toward the longitudinal axis of said casing means whereby said pole guide means may be placed in contact with the outer surface of the elongate object surrounded by said casing means for establishing and maintaining said casing means's longitudinal axis generally collinear with that of the elongate object which it surrounds.

5. The apparatus of claim number 1 further comprising longitudinal guide means having an assembled length greater than that of said casing means, said longitudinal guide means being located adjacent to said casing means with its longitudinal axis aligned generally parallel to the longitudinal axis of said elongate object, said longitudinal guide means having one of its terminal ends embedded in ground surrounding the subterranean portion of the elongate object and its other terminal end rigidly secured to the elongate object above the uppermost edge of said casing means, said rotary driver means being adapted for sliding engagement with said longitudinal guide means along its length for establishing and maintaining said casing means's longitudinal axis generally collinear with that of the elongate object which it surrounds.

6. The apparatus of claim number 1 further comprising a longitudinal drive means adapted to be rigidly secured at said longitudinal drive means's upper terminal end to the elongate object above the uppermost edge of said casing means and secured at said longitudinal drive means's lower terminal end to said rotary driver means for applying a force to the rotary driver means directed along the longitudinal axis of said casing means whereby the casing means may be urged downward into the ground surrounding the subterranean portion of the elongate object.

7. The apparatus of claim number 6 wherein the longitudinal drive means includes a pair of hydraulic cylinders having their axes of extension and retraction aligned substantially parallel to the longitudinal axis of said casing means, said hydraulic cylinders being located symmetrically about and respectively on diametrically opposite sides of the casing means's longitudinal axis, the upper terminal end of each hydraulic cylinder being rigidly secured to the elongate object above the uppermost edge of said casing means and the lower terminal end of each hydraulic cylinder being secured to said rotary driver means.

8. A casing means as may be installed as an in-ground support footing around the subterranean portion of an upstanding, elongate object, such as a structural pole, post or the like and around the immediately adjacent above-ground portions thereof, for increasing the object's structural integrity, said casing means comprising:

first and second elongated partial cylinders formed respectively with substantially equal radii, each partial cylinder being formed with a partial helical thread means located about one of its ends, each partial cylinder also being formed to mate with the other for assembly into a unitary, hollow cylinder surrounding the elongate object whereby an annulus may be established between the innermost, cylindrical surfaces of said partial cylinders and the immediately adjacent exterior surface of the elongate object, said assembled partial cylinders being disposed so each helical thread means thereof is respectively located beneath the remainder of said partial cylinder on which said helical thread means is formed, said assembled partial cylinders further including cutting means located about said helical thread means for engagement with the ground surrounding the subterranean portion of the elongate object, said cutting means being adapted for drawing said casing means downward into the ground as said casing means is rotated about its longitudinal axis; and wherein said cutting means includes a flat tooth projecting downward beneath the helical thread means of the partial cylinders, said tooth being secured to said partial cylinder at an angle with respect to the threads of said helical thread means which adapts said tooth for assisting said helical thread means in drawing said casings means downward into the ground.

9. The casing means of claim number 8 wherein said first and second partial cylinders are formed as substantially identical, complementary half-cylinders respectively having elongate longitudinal edges adapted to overlap when said partial cylinders are assembled into a unitary, hollow cylinder.

10. The casing means of claim number 8 wherein said cutting means includes an arcuate rib projecting outward from the outermost crests of the partial cylinders'-helical thread means, said rib being secured to said partial cylinder substantially parallel to the the threads of said helical thread means to assist in drawing said casing means downward into the ground.

11. An assembly for installing an inground support footing around the subterranean portion of an upstanding, elongate object, such as a structural pole, post or the like and around the immediately adjacent above-ground portions thereof, for increasing the object's structural integrity, said assembly comprising:

a casing means as may be installed as an in-ground support footing around the elongate object, said casing means including:

first and second elongate partial cylinders formed respectively with substantially equal radii, each partial cylinder being formed with a partial helical thread means located about one of its ends, said partial cylinder being formed to mate with each other for assembly into a unitary, hollow cylinder surrounding the elongate object whereby an annulus is established between the inner wall surfaces of said partial cylinders and the immediately adjacent exterior surface of the elongate object, said assembled partial cylinders being disposed so each helical thread means thereof is respectively located beneath the remainder of said partial cylinder on which said helical thread means is formed, said casing means surrounding the elongate object being disposed with its central, cylindrical longitudinal axis alinged generally parallel to the elongate object's longitudinal axis, said assembled partial cylinders further including cutting means located about said helical thread means for engagement with the ground surrounding the subterranean portion of the elongate object, said cutting means being adapted for drawing said casing means downward into the ground as said casing means is rotated about its longitudinal axis;

split casing rotary drive means as may be rigidly secured circumferentially about said casing means for coupling a torque to said casing means, which torque urges said casing means to rotate about its longitudinal axis;

rotary driver means as may mate with, engage and be supported upon said split casing rotary drive means for applying a torque thereto whereby said casing means may be urged to rotate about its longitudinal axis and to be thereby driven into the ground to a preestablished depth about the subterranean portion of the elongate object;

said split casing rotary drive means including a plurality of mating, arcuate shaped shells which upon being assembled together may be locked circumferentially about and encircle said casing means, the outer, circumferential surface of said assembled shells furthest from said casing means being adapted to mate with, engage and support said rotary driver means for applying torque to said split casing rotary drive means; and wherein the outer, circumferential surface of said assembled shells of said split casing rotary drive means encircling said casing means, which surface is adapted to mate with, engage, and support said rotary driver means, establishes a circular sprocket which encircles said casing means in a plane substantially perpendicular to the longitudinal axis of said casing means and which circular sprocket is centered about the longitudinal axis of said casing means, and wherein said rotary driver means includes:

guide means which may engage the outer surface of said split casing rotary drive means for supporting said rotary driver means upon said split casing rotary drive means and maintaining said split casing rotary drive means in alignment with the circular sprocket of said split casing rotary drive means as said split casing rotary drive means together with said casing means is rotated with respect the said rotary driver means about said casing means' longitudinal axis;

a drive chain having sufficient length that upon being formed into a closed loop encircling the assembled shells of said split casing rotary drive means the drive chain mates with and engages the circular sprocket thereof along only a segment of the circular sprocket's circumference;

drive chain guide means for establishing a path along which that portion of the drive chain's length disengaged from the circular sprocket of said split casing rotary drive means is guided, the path thus established by the drive chain guide means being disposed substantially in the plane established by the circular sprocket of the split casing rotary drive means;

tensioning means for maintaining tension in the portion of the drive chain's length disengaged from the circular sprocket of said split casing rotary drive means;

energizing means for urging the drive chain to move along the path established by the drive chain guide means whereby said casing means may be urged to rotate about its longitudinal axis with respect to said rotary drive means; and restraining means for preventing said rotary driver means from rotating about the longitudinal axis of said casing means with respect to the ground surrounding the subterranean portion of the elongate object when the energizing means urges the drive chain to move along the path established by the drive chain guide means.

12. The assembly of claim number 11 wherein the energizing means of said rotary driver means is an hydraulic motor.

13. The assembly of claim number 11 further comprising pole guide means secured to said rotary driver means which pole guide means project inward above the uppermost edge of said casing means along radii projecting from said casing means's longitudinal axis, said pole guide means being adjustable with respect to the rotary driver means for permitting their extension inward toward the longitudinal axis of said casing means whereby said pole guide means may be placed in contact with the outer surface of the elongate object surrounded by said casing means for establishing and maintaining said casing means's longitudinal axis generally collinear with that of the elongate object which it surrounds.

14. The assembly of claim number 11 further comprising longitudinal guide means having an assembled length greater than that of said casing means, said longitudinal guide means being located adjacent to said casing means with its longitudinal axis aligned generally parallel to the longitudinal axis of said elongate object, said longitudinal guide means having one of its terminal ends embedded in ground surrounding the subterranean portion of the elongate object and its other terminal end rigidly secured to the elongate object above the uppermost edge of said casing means, said rotary driver means being adapted for sliding engagement with said longitudinal guide means along its length for establishing and maintaining said casing means's longitudinal axis generally collinear with that of the elongate object which it surrounds.

15. The assembly of claim number 11 further comprising a longitudinal drive means adapted to be rigidly secured at said longitudinal drive means's upper terminal end to the elongate object above the uppermost edge of said casing means and secured at said longitudinal drive means's lower terminal end to said rotary driver means for applying a force to the rotary driver means directed along the longitudinal axis of said casing means whereby the casing means may be urged downward into the ground surrounding the subterranean portion of the elongate object.

16. The assembly of claim number 15 wherein the longitudinal drive means includes a pair of hydraulic cylinders having their axes of extension and retraction aligned substantially parallel to the longitudinal axis of said casing means, said hydraulic cylinders being located symmetrically about and respectively on diametrically opposite sides of the casing means's longitudinal axis, the upper terminal end of each hydraulic cylinder being rigidly secured to the elongate object above the uppermost edge of said casing means and the lower terminal end of each hydraulic cylinder being secured to said rotary driver means.

17. The assembly of claim number 11 wherein said first and second partial cylinders are formed as substantially identical, complementary half-cylinders respectively having elongate longitudinal edges adapted to overlap when said partial cylinders are assembled into a unitary, hollow cylinder.

18. The assembly of claim number 11 wherein said cutting means includes a flat tooth projecting downward beneath the helical thread means of the partial cylinders, said tooth being secured to said partial cylinder at an angle with respect to the threads of said helical thread means which adapts said tooth for assisting said helical thread means in drawing said casing means downward into the ground.

19. The assembly of claim number 11 wherein said cutting means includes an arcuate rib projecting outward from the outermost crests of the partial cylinders'-helical thread means, said rib being secured to said partial cylinder substantially parallel to the threads of said helical thread means to assist in drawing said casing means downward into the ground.

* * * * *